United States Patent [19]

Biddison

[11] 4,375,828

[45] Mar. 8, 1983

[54] PORTABLE INSULATED CONTAINER

[76] Inventor: Bradley O. Biddison, 4834 194th SE., Issaquah, Wash. 98022

[21] Appl. No.: 196,526

[22] Filed: Oct. 14, 1980

[51] Int. Cl.[3] ..... A45C 11/00

[52] U.S. Cl. ..... 150/2.1; 150/52 R; 62/371; 206/523

[58] Field of Search ..... 150/2.1, 2.2, 2.5, 7, 150/52 F, 52 R; 62/371, 372; 206/523

[56] References Cited

U.S. PATENT DOCUMENTS

| | | | |
|---|---|---|---|
| 1,369,448 | 2/1921 | McNab | 150/52 R X |
| 1,895,278 | 1/1933 | Crawford | 150/52 F |
| 2,289,254 | 7/1942 | Eagles | 150/2.1 UX |
| 2,632,311 | 3/1953 | Sullivan | 62/371 |
| 2,857,949 | 10/1958 | Ziff | 150/52 R |
| 4,132,257 | 1/1979 | Filosa | 150/52 R |
| 4,196,817 | 4/1980 | Moser | 150/2.2 X |
| 4,211,091 | 7/1980 | Campbell | 150/2.1 X |

FOREIGN PATENT DOCUMENTS

| | | | |
|---|---|---|---|
| 868210 | 2/1953 | Fed. Rep. of Germany | 150/7 |
| 227311 | 1/1925 | United Kingdom | 150/52 R |

*Primary Examiner*—Donald F. Norton

*Attorney, Agent, or Firm*—Seed, Berry, Vernon & Baynham

[57] ABSTRACT

A cushioned container for beverage cans and the like is formed from flexible, semi-rigid foamed material. An arched, one-piece roof panel and substantially planar bottom, back and front panels are bonded along their respective margins utilizing miter joints. The arched subchamber formed in the top of the container has flat surface areas formed in the arch for attaching removable coolant packages. The upper portion of the front panel of the container includes a tongue-shaped flap with beveled edges around its margin for releasable engagement with the corresponding beveled edges on the margin of the arched roof panel. The semi-rigid container fits within a carrying bag having a closure adjacent the margin of the flap. The flap flexes outwardly along a hinge line reinforced by the bag construction. The bag includes a collapsible lower compartment having a padded rear panel and an auxiliary strap useful for carrying or as a backpack hip strap.

11 Claims, 14 Drawing Figures

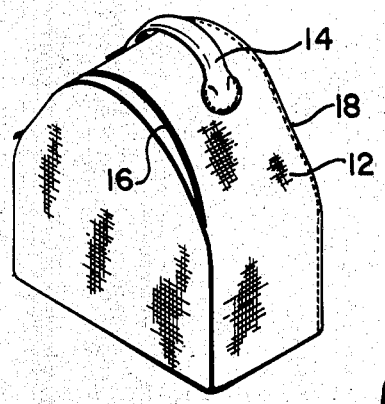
FIG. 1
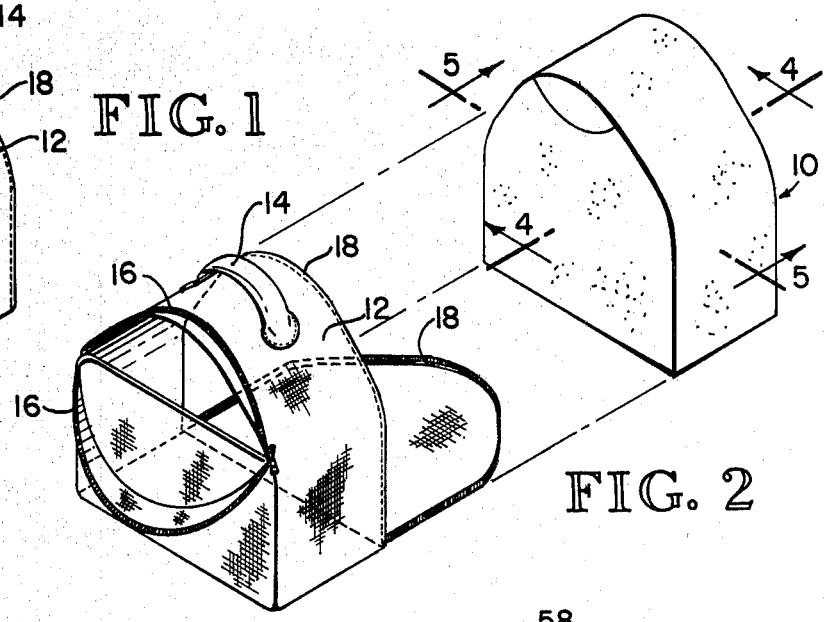
FIG. 2
FIG. 3
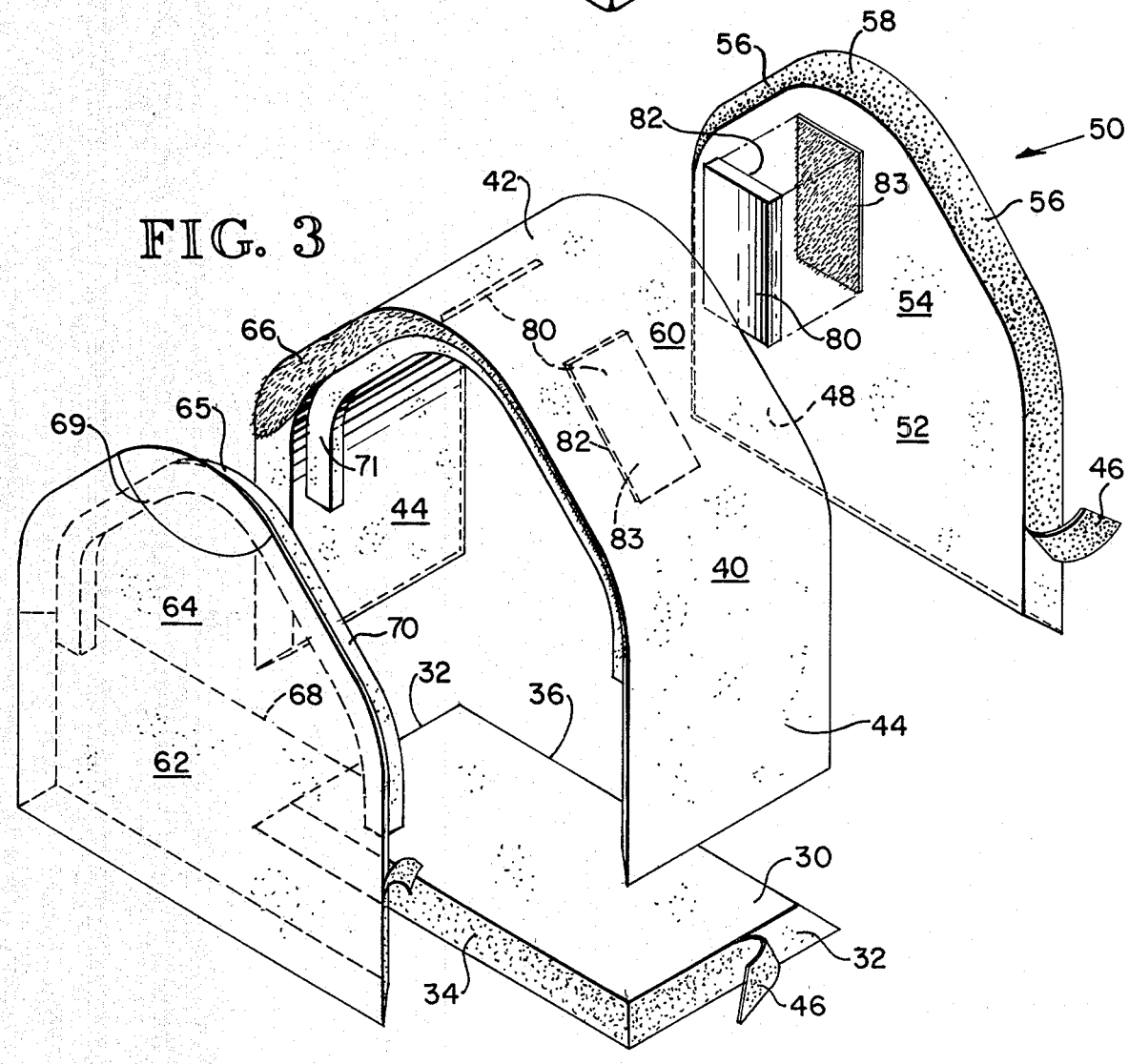

FIG. 9
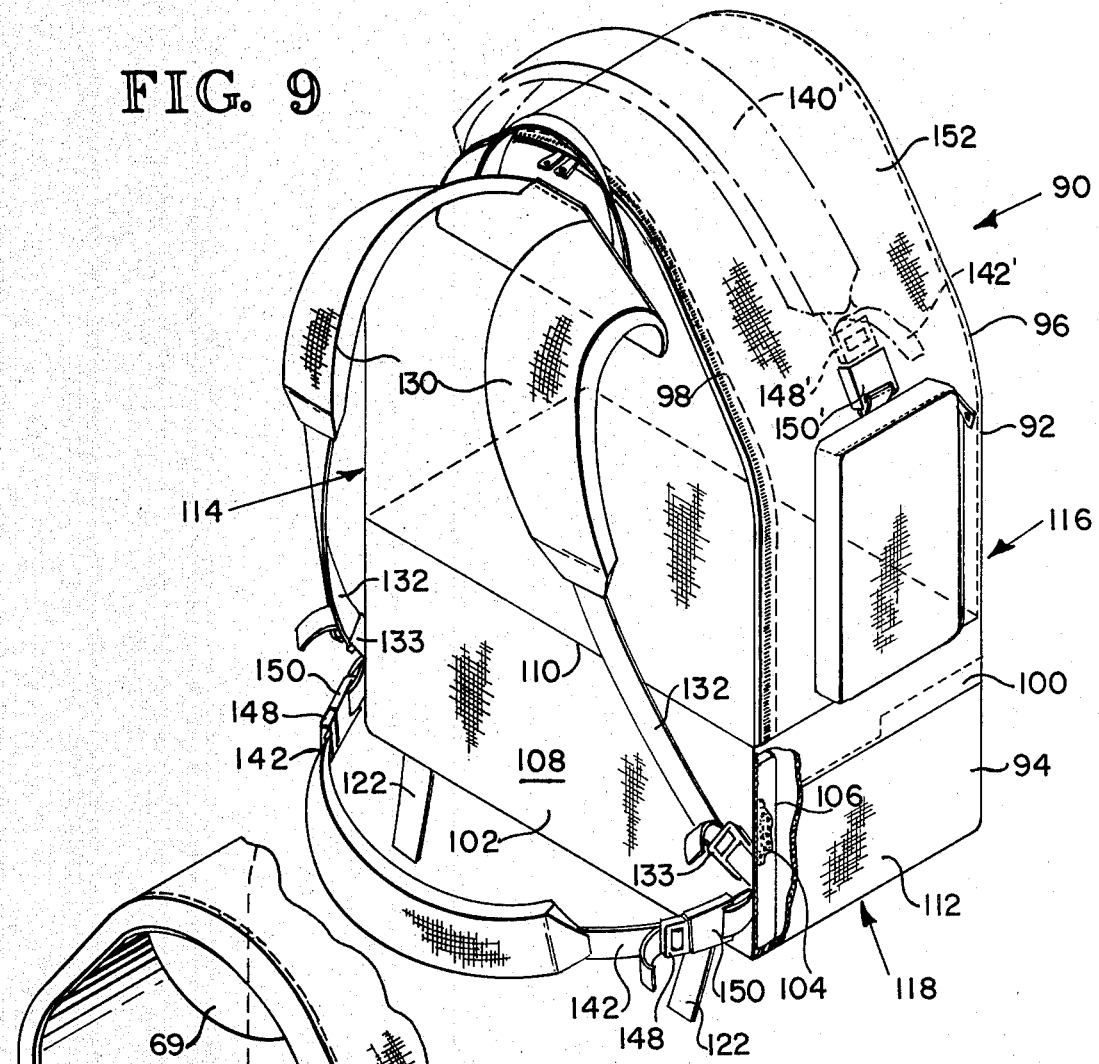
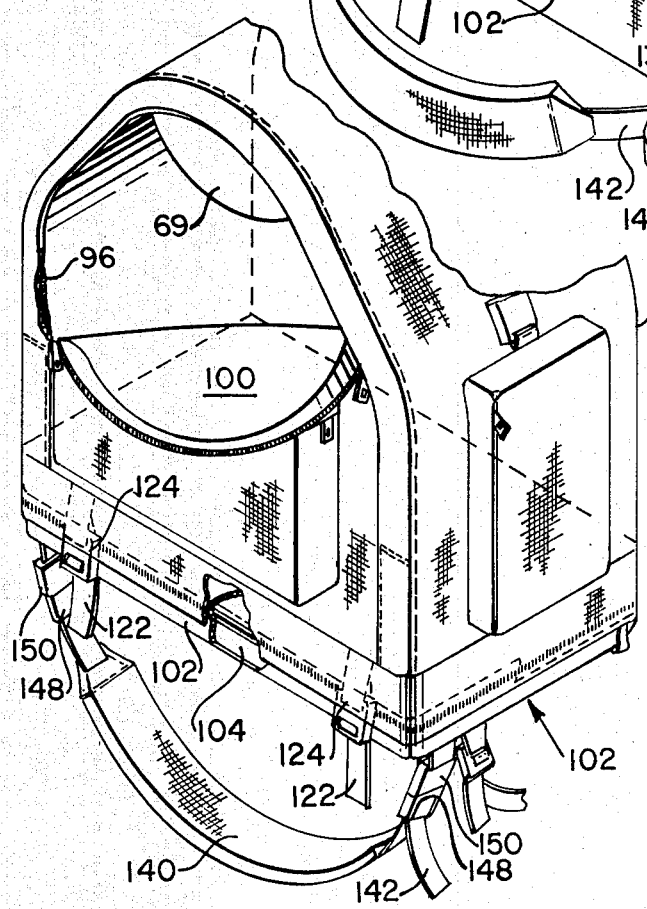
FIG. 10

FIG. 11
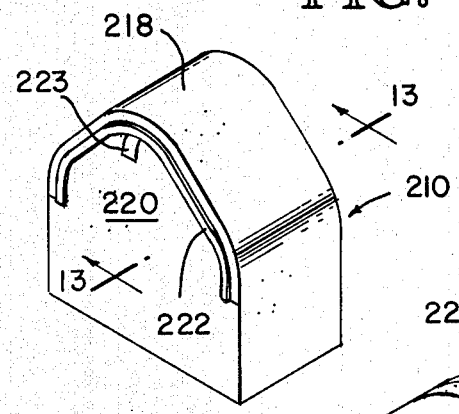
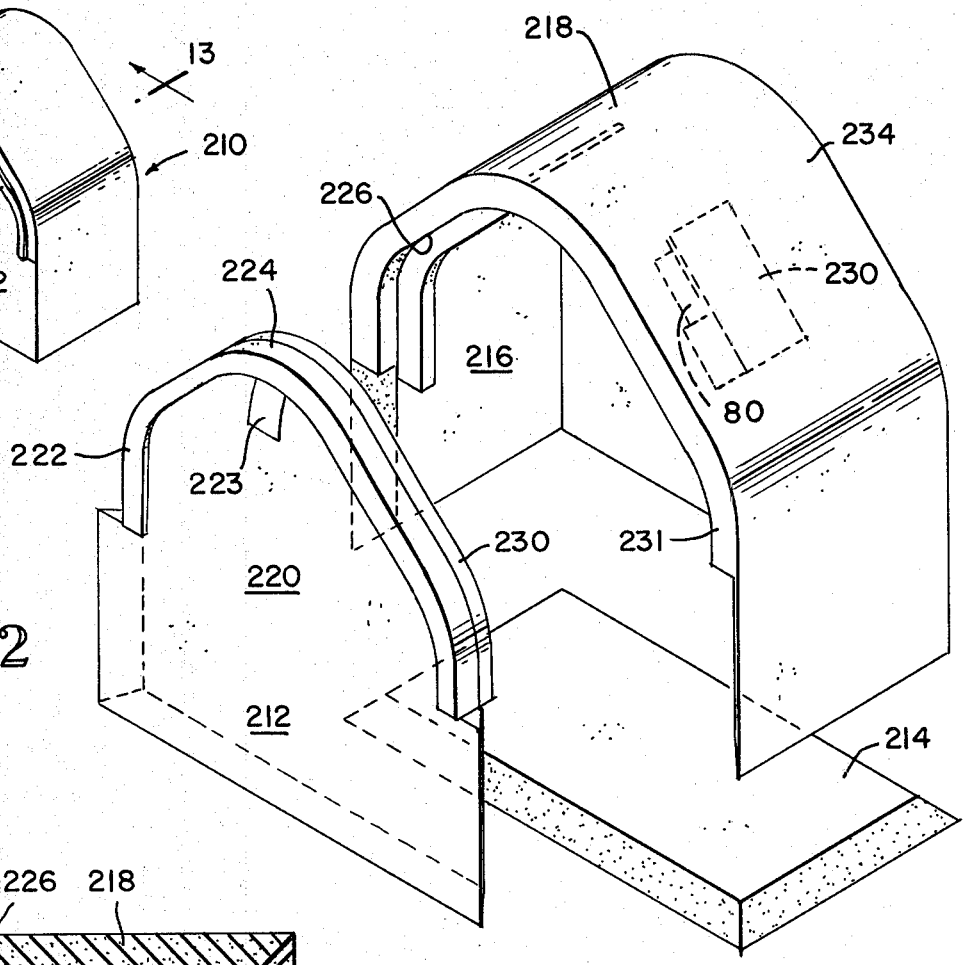
FIG. 12
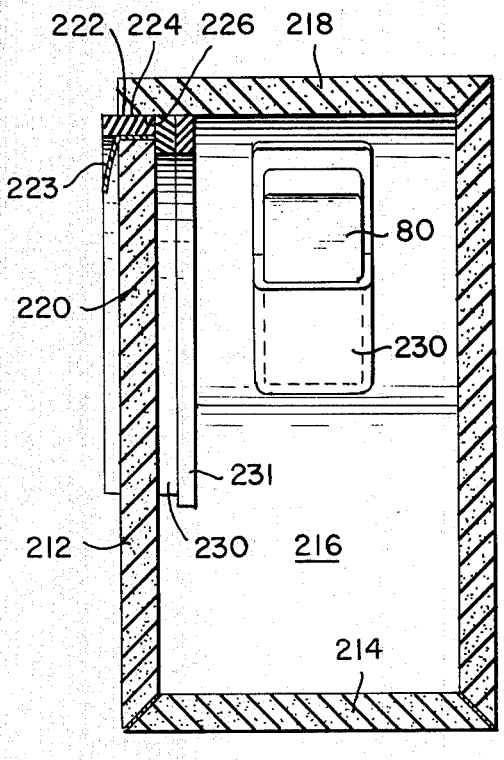
FIG. 13
FIG. 14
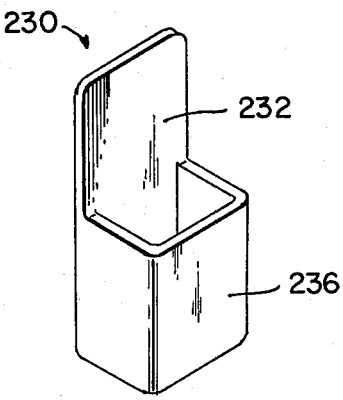

PORTABLE INSULATED CONTAINER

BACKGROUND OF THE INVENTION

1. Field of the Invention

This invention relates to thermally insulated portable containers.

2. Prior Art Relating to the Disclosure

Prior portable insulated containers for six-packs of canned beverages and for other food items are not particularly designed for being easily carried. Various types of soft-sided, insulated bags provide minimal support and cushioning for their contents. A number of hard-sided, insulated, chest-type coolers are available, such as disclosed in U.S. Pat. No. 3,255,607, which are bulky and awkward to carry. The hard exterior of these containers does not provide cushioning for their contents or for someone carrying them on, for example, a hike or an extended walk. U.S. Pat. No. 4,050,264 discloses a rigid container formed from a closed-cell synthetic resin foam which includes a removable, reusable cooling module which rests upon the contents of the container. For these generally rigid containers to be comfortably carried, additional cushioning material is required, which increases the bulk and weight to be carried. Thus these containers are not particularly suited for being carried by hikers.

SUMMARY OF THE INVENTION

It is, therefore, an object of the invention to provide a resilient, semi-rigid, thermally insulated, portable container adapted for being easily hand-carried or backpacked.

It is another object of the invention to provide a portable, thermally insulated container which integrally combines cushioning for the contents thereof and for a user carrying the container.

It is another object of the invention to provide a thermally insulated container which is formed from semi-rigid panels which are integrally bonded together to provide a strong, lightweight structure.

It is another object of the invention to provide a thermally insulated, portable container which includes removable coolant modules.

It is another object of the invention to provide a portable, thermally insulated container which includes a sealable access flap.

It is another object of the invention to provide an insulated portable container which is adapted to be received in a carrying bag.

Basically, these and other objects are achieved by a portable, thermally insulated container which is formed from a flexible insulated material and which has an upper and a lower chamber, or compartment. The upper chamber has a substantially curved roof configuration and includes a flap which provides access to the interior of the insulated container. Means are provided for integrally sealing the flap of the container. The container and and a carrying bag are particularly adapted to being easily carried by hand or backpacked because of the container's semi-rigid shape and cushioned construction.

One embodiment of the container includes a curved roof formed from a rectangular strip of semi-rigid insulating material and shaped so that its free ends are bonded to the side margins of a rectangular base. A back and a front panel each have rectangular lower portions which are joined along their edges to the roof strip to form a rectangular lower portion of the container. The upper area of the front panel forms a tongue-shaped flap which conforms to the adjoining edge roof. The flap portion bends away from the container, and closure means are located between the margin of the flap and the roof member to seal the container. One or more removable cooling modules are fastened to flat surfaces provided in the upper volume of the container to accommodate the cooling modules. The bag for carrying the container is designed to include a closure adjacent the container sealing means. The bag is designed so that it reinforces the flexure region of the flap. The bag includes a collapsible lower compartment having a pivotable, padded rear panel which provides additional support for the bag. A detachable auxiliary strap is used for either carrying the bag or as a hip strap for a backpack configuration.

BRIEF DESCRIPTION OF THE DRAWINGS

FIG. 1 is a perspective view of a carrying bag for an insulated container according to the invention;

FIG. 2 is a perspective view of an insulated container and a carrying bag which receives the insulated container;

FIG. 3 is an exploded perspective view of an insulated container according to the invention;

FIG. 9 is a rear isometric view of another embodiment of a carrying bag;

FIG. 10 is a front isometric view of the other embodiment of the carrying bag;

FIG. 11 is a perspective view of another embodiment of an insulated container;

FIG. 12 is an exploded perspective view of the insulated container embodiment of FIG. 11;

FIG. 13 is sectional view of the container embodiment taken along section line 13—13 of FIG. 11; and FIG. 14 is an enlarged perspective view of a coolant module holder.

DETAILED DESCRIPTION OF THE PREFERRED EMBODIMENT

Figure 4:
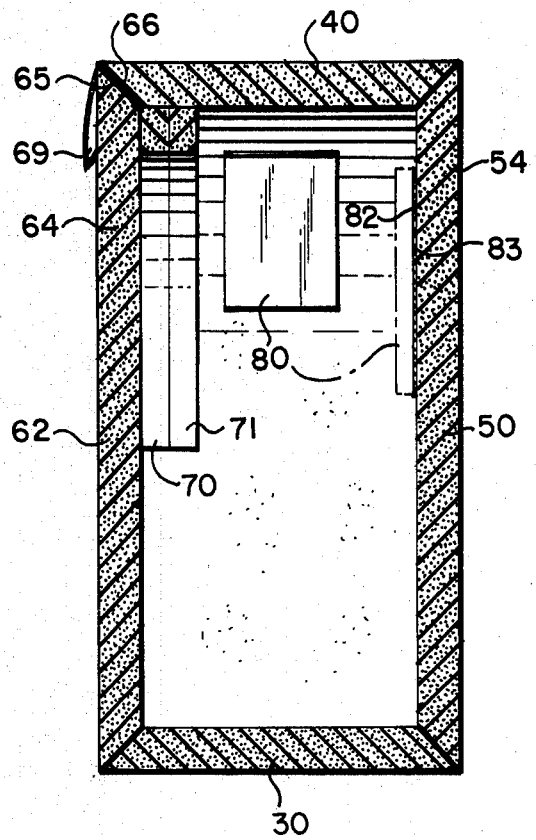
FIG. 4 is a sectional view of an insulated container taken along section line 4—4 of FIG. 2.

Referring to FIGS. 1 and 2, one embodiment of a portable, thermally insulated container 10 is shown with a carrying bag 12 which receives the container 10. This embodiment of the carrying bag 12 includes a padded strap 14 integrally attached to the top of the bag for hand-carrying. The bag 12 has a front zipper, or slidable closure, assembly 16 along its top front margin which permits access to the insulated container 10 contained within. A rear zipper assembly 18 opens on the rear of the bag and allows the insulated container 10 to be easily inserted and removed from the bag. The carrying bag 12 is made with a conventional sewn construction of a suitable cloth material, waterproofed if desired.

The portable, thermally insulated container 10 is assembled from the component pieces shown in more detail in FIG. 3. All of the panels forming the container 10 are formed from semi-rigid, insulating sheet material. The preferred material is a flexible, closed-cell foam material such as the polyolefin material supplied by Uniroyal, Inc., under the trademark "Enso-Foam," which is a softer, more flexible material than coarse polyethylene foam. The material is supplied in three-quarter-inch thick sheets and is cut or formed by conventional techniques. This material is chosen for its good insulating properties and its cushioning characteristics, as well as its semi-rigid characteristic, which allows it to form self-supporting containers.

Referring to FIG. 3, a rectangular bottom panel 30 formed from the semi-rigid insulating material has beveled edges formed along its side edges 32, front edge 34, and rear edge 36. A roof panel 40 of this embodiment has all of its edges beveled. The midsection 42 of the roof panel 40 is curved and has spaced-apart parallel side panels 44, the edges of which are bonded to the corresponding beveled edges of the base 30.

Figure 6:
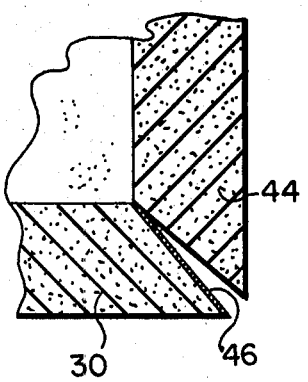
FIG. 6 is a detailed view of typical beveled edges of adjacent panels for the container showing the edges cut at slightly less than 45 degrees.
Figure 7:
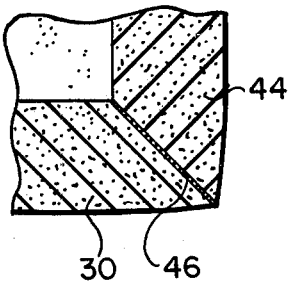
FIG. 7 is a detailed view of typical bonded edges of adjacent panels.

A preferred bonding material for all of the insulated container joints is a 3M Company double-sided adhesive transfer tape 46, Transfer Tape Adhesive No. 950. FIG. 6 typically shows that the beveled edges for the various panels are formed with angles of less than 45 degrees. FIG. 7 typically shows a finished joint having an adhesive transfer tape 46 sandwiched between the opposite beveled surfaces. The insulating maerial is compressed along the inside of the joint and expanded along the outside of the joint. This causes the insulating material along the adjoining beveled edges to be drawn together to provide an airtight bond.

Referring to FIGS. 3 and 4, a back wall panel 50 formed of semi-rigid insulating material also has beveled edges which are bonded with double-sided adhesive transfer tape 46 to the rear edge 48 of the roof panel 40 and to the rear edge 36 of the base 30. The back wall panel 50 includes a lower rectangular portion 52 and a tongue-shaped upper portion 54. The edge of the upper portion 54 of the back panel includes two oppositely angled straight portions 56 which extend upwardly at an angle toward each other and terminate in a curved top edge 58 which conforms to the shape of the midsection 42 of the roof panel 40. The beveled edges of the back wall panel 50 are bonded by adhesive transfer tape 46 to the corresponding edges of the bottom panel 30 and roof panel 40 so that the flexible roof panel 40 conforms to the back panel 50, forming flat areas 60 in the roof panel 40.

A front wall panel 62 is also formed from the semi-rigid insulating material. A lower rectangular area of the front wall panel 62 has beveled edges which are bonded to the beveled front edge 34 of the bottom panel 30 and to the front beveled edges of the side panel portions 44 of roof panel 40. The top portion of the front wall 62 is also formed with a tongue-shaped flap 64 and has beveled edges conforming to the front edge of the roof panel 40. The front flap 64 has an edge which is more rounded than the corresponding upper portion 54 of the back wall panel 50. The beveled edges of the flap 64 and the corresponding beveled edges of the roof panel 40 are optionally fastened together by closure strips 65, 66 of removably adherent material, such as known under the tradename Velcro. If the closure strips 65, 66 are not used, the corresponding beveled edges of the flap 64 and the roof panel 40 contact each other without being fastened together. When the flap 64 is closed, a closed upper chamber is formed in the container 10. The flap 64 bends away from the container along a hinge line 68 to provide access to the interior of the container. A thin vinyl tab 69 is bonded to the top of the flap 64 to aid in opening the flap 64 and releasing the optional closure strips 65, 66.

Figure 8:
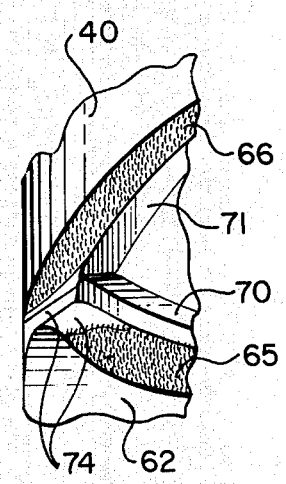
FIG. 8 is an enlarged view of the area where the flap joins the container.

As shown in FIGS. 3 and 4, a pair of rectangular sealing strips 70, 71 of insulating material are respectively bonded to the margin of the flap 64 and to the interior of the roof panel 40. When the flap 64 is closed, the strips engage each other to provide a seal. FIG. 8 shows the details of the area adjacent the hinge line 68 where the flap 64 joins the roof panel 40. The lower portions of the sealing strips 70, 71 are bonded to each other. The beveled edges of the lower portions 44 of the roof panel and the front panel 62 near the hinge line 68 have short strips 74 of vinyl bonded thereto which permit the flap 64 to bend along the hinge line 68 without unduly stretching the material or the adjacent adhesive bonds. Carrying bags for the container are designed such that the bag provides support for the container along the hinge line 68. This is accomplished by not extending the zipper 16 beyond the bend area of the flap so that the bag supports the area as the flap is bent away from the container.

Figure 5:
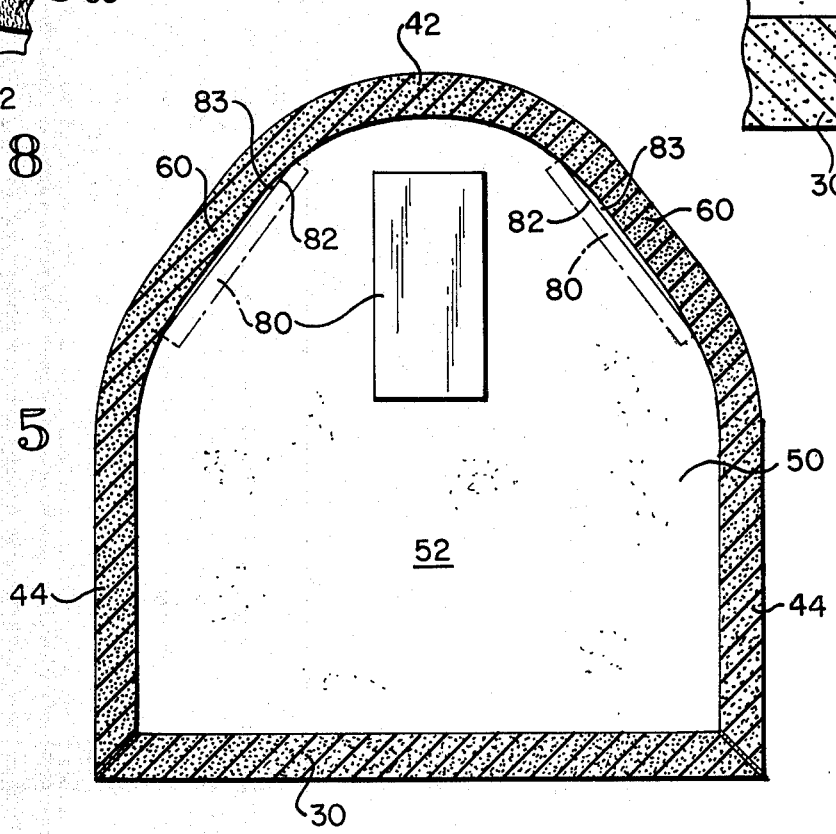
FIG. 5 is a sectional view of an insulated container taken along section line 5—5 of FIG. 2.

FIGS. 3, 4 and 5 show coolant modules 80 positioned in the arch-shaped chamber formed in the top portion of the container 10. The flat roof areas 60 and the upper portion 54 of the rear panel 50 provide substantially flat mounting surfaces for the coolant modules 80. The modules and the various wall surfaces in this embodiment of a module positioning means each have corresponding strips 82, 83 of pressure sensitive, adherent fastening material, such as Velcro strips, mounted for releasably attaching the coolant modules 80 in the upper chamber formed in the container 10. The coolant modules 80 are sealed modules which contain freezable substances, such as water or conventional ice substitutes, which are frozen prior to insertion in the container and which provide cooling for the contents of the container 10. The air within the upper chamber of the container 10 is cooled by the modules and settles by gravity to the lower chamber of the container 10 to cool the contents of the container.

FIGS. 9 and 10 show an embodiment of a versatile, cloth carrying bag 90 for the insulated container 10 described above. The bag has a contoured upper compartment 92 formed to the shape of the insulated container and a depending lower collapsible rectangular compartment 94 for carrying clothing and other items.

The upper compartment 92 upper front edge has a front zipper closure 96 which provides access to the flap of the insulated container 10. A rear zipper closure 98 along the rear edge of the upper compartment 92 permits the insulated container 10 to be easily removed from the upper compartment 92 when required.

The rectangular lower compartment 94 depends from the lower outside edges of the upper compartment 92 and is separated from the upper compartment by a rectangular bottom panel 100 which forms the bottom of the upper compartment 92. The bottom panel 100 is located just below the bottom panel of the insulated container 10 so that the top surface of the lower compartment is fixed in position. A semi-rigid, cushioned rectangular panel 102 is formed by sandwiching a rectangular sheet of semi-rigid foam material 104, similar to the sheet material forming the insulated container, between an inside sheet 106 and an outside sheet 108. The foam material 104 supports and helps the panel 102 retain its shape and provides cushioning. One long edge of the semi-rigid rectangular panel 102 is pivotably connected to the lower rear edge 110 of the upper compartment 92. This permits the rectangular panel 102 to be positioned in a vertical position defining the rear wall of the lower compartment 94 with the flexible side walls 112, 114 and front wall 116 vertically depending from the lower outside edges of the upper compartment 92. A flexible rectangular panel 118 joined to the wall panels 102, 112, 114 and 116 forms the bottom of the lower collapsible compartment 94. A zipper closure 120 is located along the front and side panels to provide access to the interior of the lower compartment 94.

The lower compartment 94 is collapsed by pivoting the rectangular rear panel 102 to a horizontal position parallel to the bottom panel 100 of the upper compartment 92. The side wall panels 112, 114 and the front wall panel 116 are pushed between the parallel rear panel 102 and the bottom panel 100 as shown in FIG. 10. A pair of short straps 122 on the free end of the panel 102 engage buckles 124 located near the outside front edges of the upper compartment 92 to hold the cushioned panel 102 in position.

The carrying bag 20 includes a pair of adjustable padded shoulder straps 130, each having one end connected near the top of the rear panel of the upper compartment 92. The other end 132 of each shoulder strap 130 is adjustably fixed using buckles 133 to one of the respective opposite side margins of the semi-rigid, cushioned rear panel 102 of the lower compartment 94. When the bag 90 is used as a backpack, the cushioned rear panel 102 on the lower compartment 94 and the cushioned, insulated container 10 in the upper compartment permit the bag 90 and its contents to be comfortably carried on one's back. The placement of the free ends of the shoulder straps on the semi-rigid rear panel 102 permits the straps to be longer and provides more room for the user's shoulders. The semi-rigid rear panel 102 also provides structural support for the ends of the straps and keeps the lower compartment 94 from collapsing.

FIGS. 9 and 10 also show a padded auxiliary strap 140 which is detachably connected at each end to the bag 90. When the bag 90 is used as a backpack, the auxiliary strap 140 is used as a hip strap, the ends 142 of the auxiliary strap 140 connected to the opposite side margins of the semi-rigid panel 102, which provides some rigidity to the bag. Each end of the auxiliary strap is adjustably connected to a buckle assembly 148 which releasably engages corresponding coupling hardware 150 fastened to the bag.

FIG. 9 shows that the auxiliary strap 140 is also useful as an adjustably carrying strap for the bag, as indicated by the phantom lines showing the strap 140'. The ends 142' of the strap are adjustably connected to buckle assemblies 148', which releasably engage the coupling hardware 150' fastened to the sides of the contoured top panel 152 of the bag.

FIG. 11 shows an alternative embodiment of a portable, thermally insulated container 210, which is similar in most aspects to the container 10 of FIG. 2 except for the flap closure details shown in FIGS. 12 and 13. This container also fits within the carrying bag described herein. A front panel 212 has a lower rectangular area with beveled edges bonded to the front beveled edges of a bottom panel 214 and to the front beveled edges of the side panel portions 216 of a roof panel 218, which is similar to the roof panel 42 shown in FIG. 3.

The front edge of the upper portion of the roof panel 218 is not beveled as shown in FIGS. 12 and 13. The top portion of the front wall panel 212 has a tongue-shaped flap portion 220 the top edge of which is cut away. An edge sealing strip 222, formed of the insulating material, is adhesively fastened along the top edge of the flap portion. The outside top face 224 of the edge strip 222 resiliently contacts the front inside edge portion 226 of the roof panel 218 to form a butt-joint seal for the container. The edge sealing strip 222 projects approximately one-half inch beyond the front surface of the flap so that the top edge of the flap is pushed into the container by the front wall of a closed carrying bag. Opening of the flap is aided by a pull-tab strip 223 of plastic or other suitable material which has one end fastened between the edge strip 222 and the top edge of the flap 220. The carrying bags for the container 210 are designed such that the part of the front panel 212, which serves as a hinge for the flap 220, is also supported by the bag structure.

FIGS. 12 and 13 show a pair of rectangular sealing strips 230, 231 formed of resilient insulating material and adhesively bonded, respectively, along the top inside margin of the flap 220 and the interior of the roof panel 218, similar to the sealing strips 70, 71 of FIGS. 3 and 4. When the flap 220 is closed, the strips 230, 231 engage to provide additional sealing for the container.

FIG. 14 shows another means for positioning coolant modules in the upper chamber of an insulated container. A molded plastic holder 230 has an elongated rear wall 232 which is adhesively bonded inside the container to the flat areas 234 formed in the roof panel 218, as indicated by FIGS. 12 and 13. Each coolant module 80 is received within and is held by a rectangular cup portion 236 formed on the lower half of a coolant module holder 230. The dimensions of the cup 236 are such that a coolant module snugly fits and is easily removed when necessary.

While particular embodiments of the invention have been shown and described, it should be understood that the invention is not limited thereto since many modifications may be made. It is therefore contemplated to cover by the present application any and all such modifications that fall within the true spirit and scope of the basic underlying principles disclosed and claimed herein.

I claim:

1. A thermally insulated, portable container assembly comprising a flexible outer carrying bag and an inner container adapted to be positioned within said outer bag;

said inner container including walls being formed of flexible insulating material to provide an insulated chamber;

a flexible flap member integrally forming a portion of one of the chamber walls, said flap member being displaceable to provide access to the interior of the inner container;

sealing means for sealing said flap member to the adjacent edges of said inner container; and said carrying bag including a displaceable flap portion adjacent to the displaceable flexible flap member of said inner container.

2. The portable container assembly of claim 1 wherein said container chamber has an upper and a lower portion, with the flexible flap member formed in the upper portion, and wherein the upper portion of the chamber includes means for positioning a removable coolant module therein.

3. A self-supporting, thermally insulated, portable container, comprising:

a rectangular bottom panel formed from a sheet of semi-rigid insulating material and having opposed side margins and front and rear margins;

a roof panel formed from a rectangular sheet of semi-rigid insulating material and having a curved midsection with two opposite spaced-apart arms, with the free ends of said spaced-apart arms bonded respectively to the side margins of said bottom panel;

a back wall panel formed from a sheet of semi-rigid insulating material having the margins thereof conforming to the curved midsection and oppositely spaced apart arms and bonded thereto along the margins therebetween;

a front wall panel formed from a sheet of semi-rigid insulating material having a lower rectangular area bonded along its outer margins to the front margins of said bottom panel and oppositely spaced arms to form a substantially rectangular chamber in the lower part of the container, the upper area of the front wall panel forming a flap movable between a closed position forming with the curved midsection of the roof panel an arched upper chamber in said container, said flap bendable away from said container to a second opened position to provide access to the interior of said container.

4. The container of claim 3 wherein the semi-rigid insulating material is a flexible closed-cell material.

5. The container of claim 3 wherein respective panels are bonded together using double-sided adhesive transfer tape.

6. The container of claim 3, including means for positioning a removable cooling module in the upper chamber.

7. The container of claim 3, including a strip of flexible material positioned along the margin of the flap and providing a seal for the container when the flap is in the closed position.

8. The container of claim 3 wherein the margins of the bottom panel, the roof panel and the front wall panel are correspondingly beveled to form miter joints.

9. The container of claim 8 wherein the beveled margins of the miter joints are each formed at angles less than 45 degrees so that the insulating material is compressed at the inside of the joint and tensioned at the outside of the joint to provide contact between the adjacent beveled margins.

10. The container of claim 3, including closure means located between the front margin of the curved midsection and the flap margin for removably fastening the flap margin to the curved midsection, said closure means including strips of materials which releasably adhere when pressed together.

11. The container of claim 3, including a flexible carrying bag for receiving said container and including a closure means formed in said bag adjacent to the (container sealing means) flap allowing access thereto, said closure means terminating such that the bag structure reinforces the bendable region of said container and flap.

* * * * *